United States Patent [19]

Wahlstrom et al.

[11] 4,356,932

[45] Nov. 2, 1982

[54] CASING FOR ROTARY MACHINE

[75] Inventors: Lennart Wahlstrom, Tumba; Lars K. J. Ehnstrom, Tullinge, both of Sweden

[73] Assignee: Alfa-Laval AB, Tumba, Sweden

[21] Appl. No.: 275,701

[22] Filed: Jun. 22, 1981

[30] Foreign Application Priority Data

Jun. 23, 1980 [SE] Sweden ..... 8004612

[51] Int. Cl.[3] ..... B65D 43/14; B65D 51/04

[52] U.S. Cl. ..... 220/329; 220/213

[58] Field of Search ..... 220/329, 332, 213

[56] References Cited

U.S. PATENT DOCUMENTS 3,237,799 3/1966 Petruccio ..... 220/332 X 3,804,288 4/1974 Piegza ..... 220/329

*Primary Examiner*—George T. Hall

*Attorney, Agent, or Firm*—Cyrus S. Hapgood

[57] ABSTRACT

An evacuable casing for a rotor machine comprises a cover surrounding the machine, bearing means mounting the cover for rotation on a foundation, the cover having an endless base edge, and sealing means extending along the base edge to seal against the foundation when a vacuum is applied within the cover. One part of the cover is mounted for movement relative to a second part of the cover to form a large opening in the cover, this opening in combination with said rotation of the cover on the foundation providing easy access to the machine from any radial direction.

10 Claims, 9 Drawing Figures

Fig. 2
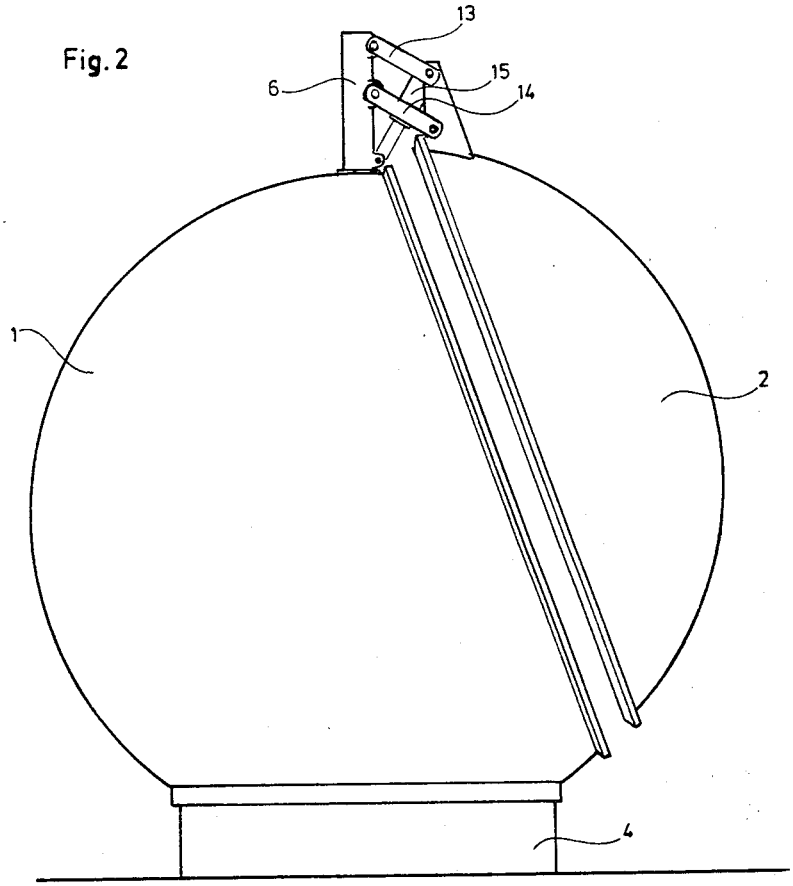
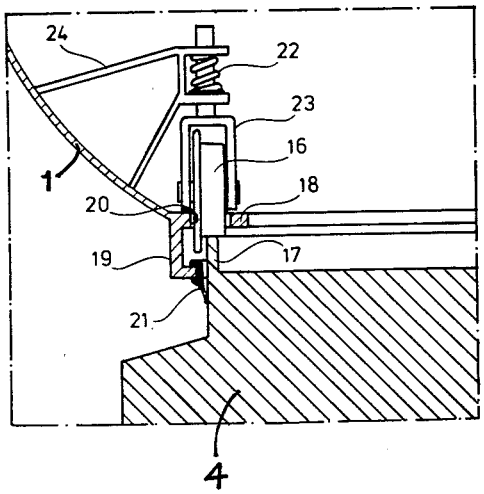
Fig. 3a
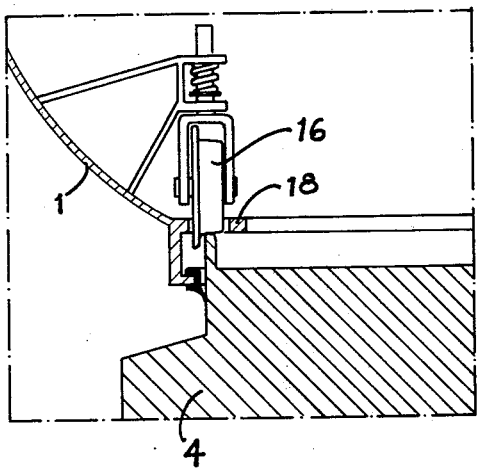
Fig. 3b

CASING FOR ROTARY MACHINE

The present invention relates to an evacuable casing for a rotor machine such as a centrifugal separator.

The energy consumption of rotor machines such as modern rapid centrifugal separators constitutes a great part of total operating costs. Therefore, there have been suggested different methods to achieve vacuum around the rotating parts in order to reduce losses due to friction with the ambient atmosphere, thereby reducing the power requirement. From the labor environment point of view, the increased noise-level due to increasing rotor speeds constitutes a further problem.

Though the problems mentioned above and the solutions thereof suggested below are common to all rapid rotor machines, the following description specially refers to centrifugal separators by way of example and without limitation.

To solve the above-mentioned problems, two different methods have been suggested. One way is to modify the centrifuge design to allow evacuation of the rotor itself inside the centrifuge cover. This method, however, has not yet gained any extensive use, and one of the reasons is the difficulties in achieving an effective and non-power consuming sealing between rotor and separator bowl. The way is to build the entire separator in a pressure room, locating all the centrifuges of a plant in a common evacuable room in order to reduce capital costs. One disadvantage with this solution is that the room must be brought to atmospheric pressure as soon as an individual separator requires attention or repairing, which increases the evacuation costs and reduces the effective time of operating during which the vacuum can be utilized. Further, a vacuum room of large dimensions must be able to withstand a high load, and particularly in case of modifying existing plants, expensive reconstruction work may be required. Also, for reasons related to plant design, it may be awkward or impossible to locate all centrifuges of a plant in a collected group.

According to the present invention, a casing is arranged around a single separator. Such an arrangement has been regarded as having disadvantages, apart from pure cost aspects, namely, the space problem and access problem with respect to attention and repairing. According to the invention these disadvantages have been successfully eliminated by a casing mainly characterized by a cover arranged on a foundation to surround the separator as well as its drive motor, the cover being rotatably mounted with respect to the foundation through bearing means and having an endless base edge and sealing elements along said base edge to seal against the foundation, at least when a subatmopheric pressure is applied within the cover. The cover is further provided with at least one part which is movable with respect to the remaining part of the cover to form a comparatively large opening in the cover, said opening in combination with the rotation of the cover with respect to the foundation providing easy access from any radial direction.

The cover is preferably made symmetrical with respect to rotation around a vertical axis in order to save space. The rotation-symmetrical design can further be advantageously utilized in that an arbitrarily large part of the cover can be arranged so that, after a slight displacement from a sealing position with the remaining part of the cover, it can be moved close to the same, very little additional space being required for opening the cover.

From the access point of view, the movable cover part is preferably arranged to follow the remaining cover part when rotating the latter. However, a simple opening arrangement can be achieved by releasing the movable cover part by means of a device located outside the cover. An example is a spherical cover provided with a movable cover part that is fixed to the foundation by linking means to be pivoted out from the remaining cover part. If in such an arrangement the movable cover part is sufficiently moved out, access to the separator is possible also from the selector occupied by the movable cover part. Another possibility is to lift the movable cover part by means of an overhead crane or the like.

Among different rotation-symmetrical embodiments, a cylindrical cover is a simple alternative from the manufacturing point of view. However, considering the relatively high stresses caused by evacuation of the cover, a dome shaped construction is more feasible.

For reasons stated above and further reasons stated below, a cover with the shape of a spherical segment seems to be the most advantageous. The design of a conventional centrifugal separator with vertical shaft of rotation provides good utilization of the space in a spherical cover. The opening in the cover may be directed upwards to some extent, whereby heavy machine parts can be lifted straight up in the conventional way. By locating the centrifuge with its central axis asymmetrical with respect to the central axis of the cover, the rotor may be lifted up in said manner. The spherical shape further makes possible an essentially smaller base diameter than the largest diameter of the cover, which reduces the costs for bearing and sealing means along the annular base edge and reduces the stresses on the foundation formed by the vacuum. Further, the spherical shape is advantageous for achieving sealing between the movable cover part and the remaining cover along a circular border.

Since the casing according to the invention is to be rotatable around its base edge, the connection lines to the separator and the motor should preferably be drawn through the foundation within said base edge. To facilitate installation in a previously built room, an essentially circular plinch may be arranged with the connection lines drawn through the flank of the plinch up through the top face of the same.

By operating a centrifugal separator under vacuum in a casing according to the invention, such a considerably saving of energy can be achieved through reduced no-load effect that the costs of manufacture and installation for the casing will be repaid within a few years of operation. Further, a considerable reduction in noise level is obtained through the casing according to the invention. It has been shown through tests that the noise level can be reduced in the range of 4–5 dB by halving the ambient pressure. This means that a noise reduction of about 15 dB is obtained by means of a vacuum of about 0.125 atm. In addition, the noise is also reduced by the cover itself. Depending on the kind of material and wall thickness of the cover, the last reduction can be about 20–30 dB, giving a total noise level reduction of about 35–45 dB.

If high vacuum is desired within the cover, special measures may be needed for cooling the drive motor. One possibility is to use a water cooling system. For example, cooling coils through the motor may be connected to a heat exchanger outside the cover, such as a cooling tower. A very simple air cooling method may be sufficient. For example, a certain air stream to be aspirated from outside to the motor, whereby the device for evacuating the cover can be utilized so that no additional air circulation apparatus is required.

The invention will be further described by means of a few embodiments shown only as examples in the accompanying drawings, in which FIG. 1 is an elevational view of a spherical casing;

FIG. 2 is a similar view of an alternative opening device for the casing according to FIG. 1;

FIGS. 3*a* and 3*b* are partial views in cross-section of the device according to FIG. 1;

Figure 1:
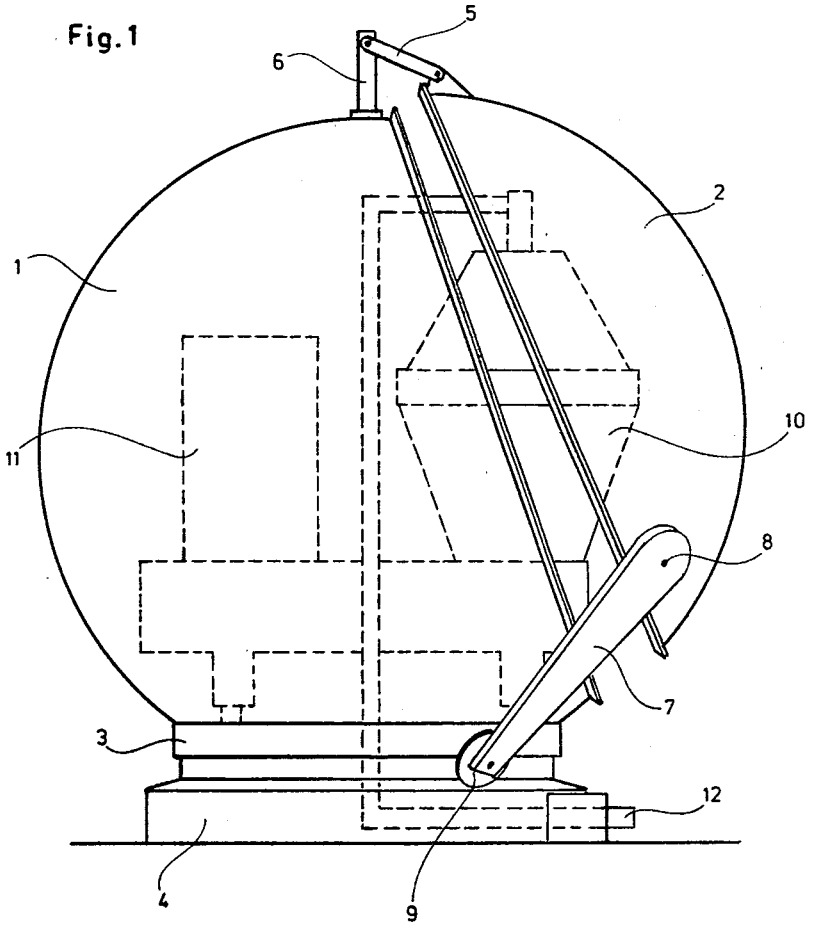

As shown in FIG. 1, a ball-shaped cover 1, 2 has one part rotatably mounted along an endless circular base edge 3 on a plinch 4. A second part 2 of the cover is fixed at a sleeve 6 rotatably journalled on top of the cover part 1 and is provided at its lower part with two supporting legs 7 (only one is shown in the figure, since the other one is covered by the first one). The support legs 7 are pivotally fixed to the cover part 2 at pivoting points 8 and are provided at their lower ends with wheels 9. In opened position, as shown in FIG. 1, the cover part 2 is lifted out sufficiently from the cover part 1 to be freely rotated with respect to the part 1 on the wheels 9 resting against the plinch 4. To close the cover, the wheel ends of the support legs are brought apart from each other, whereby the pivoting points 8 are lowered and consequently also the cover part 2. The two cover parts then seal against each other along endless, circular, inwardly-converging sealing faces. For easy operation of the support legs 7 when opening and closing the cover, suitable hydraulic or pneumatic means may be applied (not shown).

The location of the separator 10 with its drive motor 11 within the cover has been marked by dotted lines. By mounting the separator with its rotor shaft located sidewards of the vertical central axis of the spherical cover, the rotor can be lifted straight up as shown in FIG. 1 when the cover part 2 has been displaced to overlap the part 1. Connection lines 12 are arranged through the flank of the plinch 4 and extend to the separator 10.

There is shown in FIG. 2 an alternative mechanism to lift out the cover part 2 in a rotatable position. The cover part 2 is fixed to the rotatable sleeve 6 by means of two parallel linking arms 13, 14. An hydraulic piston-cylinder device 15 with its piston part fixed to the sleeve 6 and its cylinder part fixed to the cover part 2 serves as lifting means.

In FIGS. 3*a* and 3*b*, the cover part 1 is journalled on a number of wheels 16 which rest upon a circular rail 17 on the plinch 4. The cover part 1 has a circular base edge including a horizontal part 18 and a part 19 that projects downwards outside the rail 17. Apertures 20 are provided for the wheel 16 in the edge part 18. An endless circular sealing member 21 is fixed to the base edge part 19 to seal against the vertical face of the plinch 4. The cover part 1 is movable against spring force in the vertical direction with respect to the wheel 16 through spring means 22 arranged between forked element 23 journalled at the wheel shafts and support elements 24 fixed to the cover part 1. The spring force is adjusted so that the cover 1, 2 at a certain vacuum within the same is pressed with its base edge part 18 against the rail 17 to the position shown in FIG. 3*b*. At atmosphere pressure within the cover, the cover is raised by means of the spring force to its rotatable position shown in FIG. 3*a*.

Figure 4:
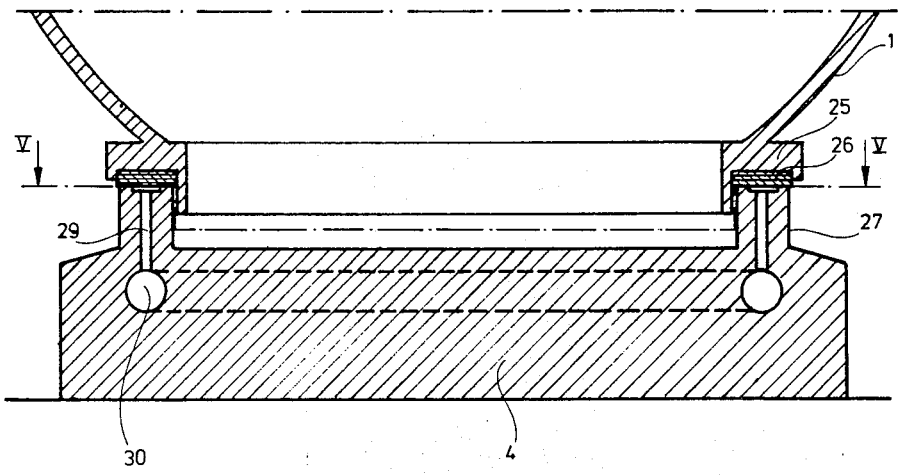
FIG. 4 is a view in vertical cross section of an alternative bearing arrangement.
Figure 5:
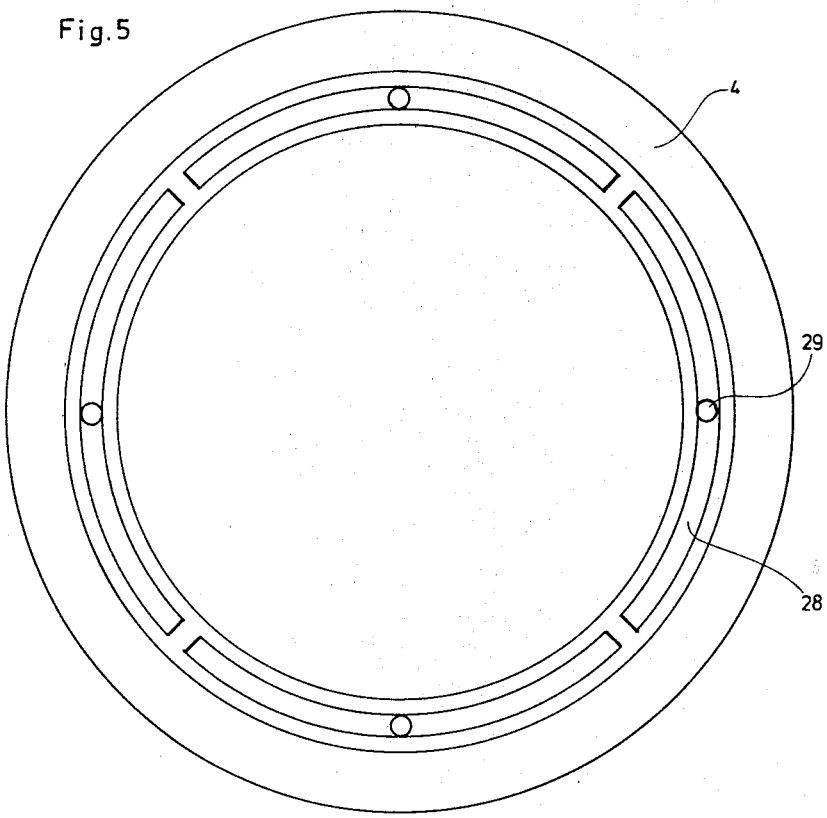
FIG. 5 is a plan view of the foundation part of the bearing means of the device according to FIG. 4.

An air-cushion bearing arrangement is shown in FIGS. 4 and 5. The cover part 1 rests on its circular base edge 25, provided with an annular elastic sealing 26, against a circular list 27 projecting upwards from the plinch 4. In the list 27 a number of separate grooves 28 are provided to form so-called air-cushions against the sealing 26. Each groove 28 is provided with a supply channel 29 connected to a compressed-air line 30.

Figure 6:
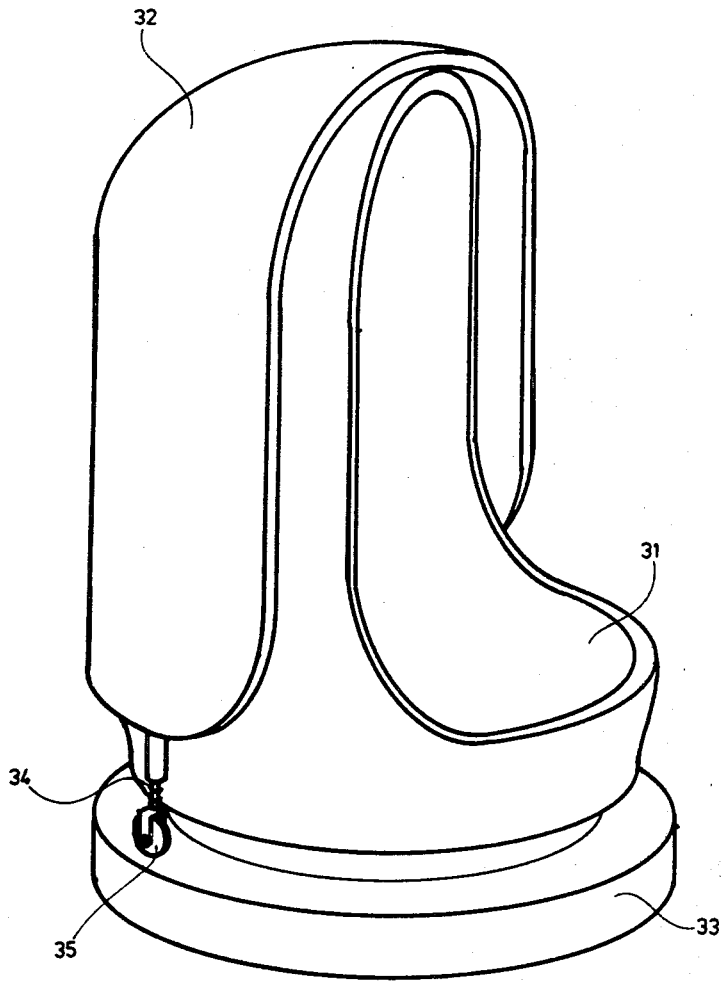
FIG. 6 is a perspective view of a cylinder-shaped casing.
Figure 7:
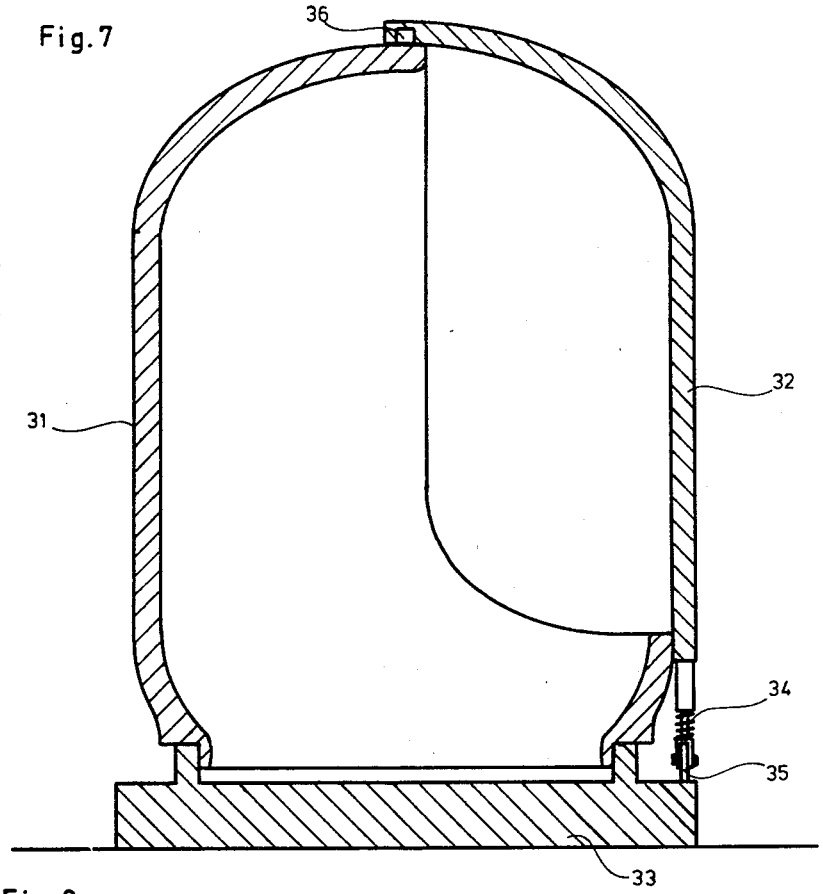
FIG. 7 is a view in vertical cross-section of the device according to FIG. 6.
Figure 8:
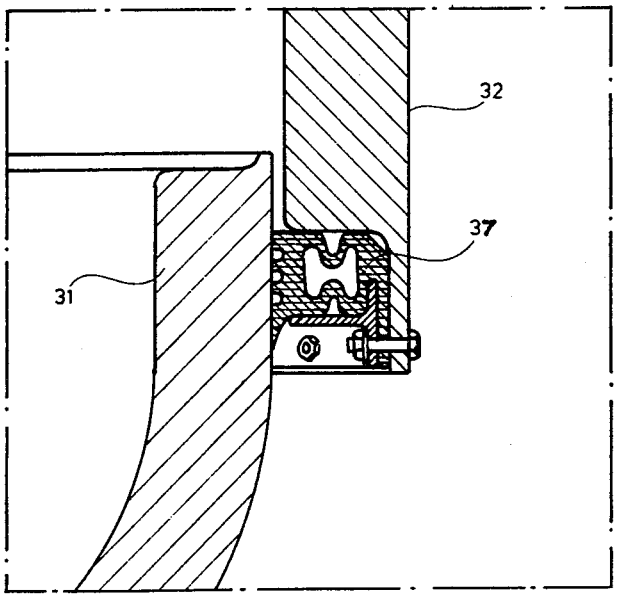
FIG. 8 shows a detailed view in cross section of a sealing arrangement for the embodiment shown in FIGS. 6 and 7.

As shown in FIGS. 6–8, a cylinder-shaped casing comprises two cover parts 31 and 32 which are movable with respect to each other. The cover part 31 is rotatably journalled with respect to the plinch 33, as by means of any bearing arrangement shown in context with the embodiments according to FIGS. 1–5. The second cover part 32 is rotatably mounted by spring means 34 and wheels 35 on the plinch 33; and when no vacuum is supplied within the cover, its part 32 can be rotated around the cover part 31 on a journal pin 36 fixed at the top of the cover part 31 (FIG. 7). Upon application of vacuum within the cover, the cover part 32 is pressed against spring force from the spring means 34 down against the cover part 31. To achieve complete sealing between the cover parts, an inflatable sealing means 37 is fixed to the cover part 32.

The cover of the casing according to the invention can be manufactured of different materials. Examples are metals such as aluminum and steel, glass fiber reinforced plastic, etc. A specially interesting material in this context is glass fiber reinforced concrete. This material provides a good sound insulation and is comparatively cheap. Specially when concrete is used, it is important to select a cover design to minimize tensile stresses. In such a case the spherical shape seems to offer a very good solution. Circular contact surfaces are obtained not only between one of the cover parts and the foundation but also between the two cover parts. These contact surfaces can be made practically free from tensile stresses. According to tests carried out with fiber reinforced concrete, a material thickness as thin as 10 mm for a spherical cover with a diameter of 2. 5 m can be used in a casing according to the invention without any strength hazards. For the edges around the openings, larger dimensions or special reinforcements are of course required.

We claim:

1. In combination with a rotor machine having a drive motor and mounted on a foundation, an evacuable casing for said machine comprising a cover arranged on the foundation to surround said machine and its drive motor, bearing means mounting the cover for rotation relative to the foundation, the cover having an endless base edge, sealing means extending along said base edge to seal against the foundation when a sub-atmospheric pressure is applied within the cover, the cover including first and second parts and means mounting said second part for movement relative to said first part to form a large opening in the cover, said opening in combination with said rotation of the cover relative to the foundation providing easy access to said machine from any radial direction.

2. The combination of claim 1, in which the cover is rotationally symmetric relative to a vertical axis.

3. The combination of claim 1, in which said second part of the cover is movable essentially parallel with and close to the surface of said first part to form said opening.

4. The combination of claim 1, in which the cover has the shape of a hollow spherical segment.

5. The combination of claim 1, in which said means mounting the second cover part for movement relative to the first cover part includes linking means connecting said cover parts to each other, said linking means being rotatably journalled on the top of said first cover part, the combination comprising also means for lifting said second cover part from a position in which the cover is closed to a raised position in which said second cover part is rotatable relative to said first part to form said opening.

6. The combination of claim 1, in which said means mounting said second cover part includes roller means at the base of said second part, the combination comprising also a circular track, said roller means being operable to support said second part and to roll along said track as said second part moves relative to said first part.

7. The combination of claim 6, in which said means mounting said second cover part also includes legs on which said roller means are mounted and which are pivotally fixed at pivoting points on said second cover part, the legs being adapted to pivot as the roller means roll along the circular track whereby said pivoting points and second cover part are raised relative to said first cover part.

8. The combination of claim 1, in which said bearing means are roller means.

9. The combination of claim 8, comprising also spring means through which said roller means are fixed to one of said cover and foundation, the cover being rotatably supported on the roller means when atmospheric pressure prevails in the cover, the cover being pressed down against the action of said spring means when sub-atmospheric pressure is applied within the cover, whereby said endless base edge is contacted with said foundation.

10. The combination of claim 1, in which said bearing means includes air-cushion means.

* * * * *